US007852003B2

(12) United States Patent
Kwon et al.

(10) Patent No.: US 7,852,003 B2
(45) **Date of Patent: *Dec. 14, 2010**

(54) PLASMA DISPLAY PANEL HAVING DIMENSION RELATIONSHIP BETWEEN WIDTH OF ELECTRODES AND BARRIER RIB PITCH

(75) Inventors: Jae-Ik Kwon, Asan-si (KR); Kyoung-Doo Kang, Seoul (KR)

(73) Assignee: Samsung SDI Co., Ltd., Suwon (KR)

( * ) Notice: Subject to any disclaimer, the term of this patent is extended or adjusted under 35 U.S.C. 154(b) by 295 days.

This patent is subject to a terminal disclaimer.

(21) Appl. No.: 11/850,253

(22) Filed: Sep. 5, 2007

(65) Prior Publication Data

US 2008/0042572 A1 Feb. 21, 2008

Related U.S. Application Data

(63) Continuation of application No. 11/054,945, filed on Feb. 11, 2005, now Pat. No. 7,279,836.

(30) Foreign Application Priority Data

Feb. 20, 2004 (KR) ..... 10-2004-0011333

(51) Int. Cl.
*H01J 17/49* (2006.01)

(52) U.S. Cl. ..... 313/587; 313/584; 313/585; 313/586

(58) Field of Classification Search ..... 313/582–587
See application file for complete search history.

(56) References Cited

U.S. PATENT DOCUMENTS

| | | | | |
|---|---|---|---|---|
| 5,136,207 | A * | 8/1992 | Miyake et al. | 313/582 |
| 2003/0010019 | A1 | 1/2003 | Engel et al. | |
| 2003/0076037 | A1 * | 4/2003 | Choi | 313/582 |
| 2003/0080682 | A1 * | 5/2003 | Nagano | 313/582 |
| 2003/0173900 | A1 | 9/2003 | Inan et al. | |
| 2004/0000873 | A1 | 1/2004 | Moon | |
| 2004/0207324 | A1 * | 10/2004 | Fujitani | 313/582 |

FOREIGN PATENT DOCUMENTS

| | | |
|---|---|---|
| CN | 1414596 | 4/2003 |
| JP | 1997-330663 | 12/1997 |
| WO | 03/088298 | 10/2003 |

OTHER PUBLICATIONS

Chinese Office Action dated Oct. 17, 2008.
Certificate of Patent for Invention No. 593902 issued Jan. 27, 2010 by the State Intellectual Property Office of the People's Republic of China.

* cited by examiner

*Primary Examiner*—Bumsuk Won
(74) *Attorney, Agent, or Firm*—H.C. Park & Associates, PLC

(57) ABSTRACT

A plasma display panel including a sustain electrode pair comprising an X electrode and a Y electrode that are separated from each other by a discharge gap, and a barrier rib formed on a second substrate facing the first substrate and including first barrier ribs and second barrier ribs that define a discharge cell. Assuming that L is a sum of a width of the discharge gap and widths of the X and Y electrodes, P is a pitch between neighboring second barrier ribs, and H is a height of the first barrier ribs, a value of H satisfies $200 \times L/P-25 \leqq H\ (\mu m) \leqq 200 \times L/P-5$.

17 Claims, 4 Drawing Sheets

PLASMA DISPLAY PANEL HAVING DIMENSION RELATIONSHIP BETWEEN WIDTH OF ELECTRODES AND BARRIER RIB PITCH

CROSS REFERENCE TO RELATED APPLICATIONS

This application is a continuation of prior application Ser. No. 11/054,945, filed Feb. 11, 2005, and claims priority to and the benefit of Korean Patent Application No. 10-2004-0011333, filed on Feb. 20, 2004, which are both hereby incorporated by reference for all purposes as if fully set forth herein.

BACKGROUND OF THE INVENTION

1. Field of the Invention

The present invention relates to a plasma display panel (PDP), and more particularly, to a PDP and method for fabricating the same having improved discharge stability and discharge efficiency.

2. Description of the Related Art

Generally, a PDP forms an image by generating a glow discharge by applying a voltage to electrodes, installed in a gas-filled sealed space, to excite a phosphor layer using ultraviolet rays generated during the glow discharge operation.

A PDP may be classified as a direct current (DC), alternating current (AC), or hybrid type according its driving method, and it may also be classified as a two-electrode or three-electrode type according to the number of electrodes. The DC type includes an auxiliary electrode for inducing an auxiliary discharge, and the AC type includes an address electrode for improving address speed by dividing address and sustain discharges.

The AC type may be classified as an opposed discharge or a surface discharge type according to an arrangement of the discharge performing electrodes. The opposed discharge type includes two discharge sustain electrodes disposed on facing substrates to generate the discharge perpendicularly to the panel, and the surface discharge type includes two discharge sustain electrodes disposed on the same substrate to generate the discharge on a plane of the substrate.

In a PDP having the above structure, discharge cells are disposed between the substrates, and FIG. 1 shows a cross section of a unit discharge cell.

Referring to FIG. 1, in a discharge cell 10, a sustain electrode 12, which includes an X electrode 13 and a Y electrode 14, is formed on a lower surface of a first substrate 11. The X electrode 13 and the Y electrode 14 function as a common electrode and a scan electrode, respectively, and they are separated from each other by a discharge gap g.

The X electrode 13 and the Y electrode 14 respectively include transparent electrodes 13*a* and 14*a* and bus electrodes 13*b* and 14*b*, which are formed on lower surfaces of the transparent electrodes 13*a* and 14*a* to apply voltages. A first dielectric layer 15 covers the sustain electrode 12, and a protective layer 16 covers the first dielectric layer 15.

A second substrate 21 faces the first substrate 11, and an address electrode 22 is formed on the second substrate 21. A second dielectric layer 23 covers the address electrode 22. A phosphor layer 24 is formed on the second dielectric layer 23, and a discharge gas is injected into the discharge cell 10.

Applying an address voltage between the address electrode 22 and the Y electrode 14 addresses the discharge cell 10 and forms a wall charge in it. Applying a sustain voltage between the X electrode 13 and the Y electrode 14 of the addressed discharge cell 10 causes a sustain discharge. The discharge generates electric charges that collide with the discharge gas to form the plasma and ultraviolet rays. The ultraviolet rays excite the fluorescent material on the phosphor layer 24 to display an image.

The discharge between the X electrode 13 and the Y electrode 14 starts at the discharge gap g and diffuses along the surfaces of the X electrode 13 and the Y electrode 14 from the discharge gap g. The discharge does not diffuse when a voltage difference between the X electrode 13 and the Y electrode 14 is less than a discharge start voltage. A dotted line in FIG. 1 shows a sustain discharge path that is formed in the discharge cell 10.

If the discharge cell 10 is not high enough, the discharge path may contact the phosphor layer 24, thereby degrading discharge efficiency. Further, ions generated in the discharge process that collide with the phosphor layer 24 reduce the layer's life span. However, if the discharge cell 10 is too high, it negatively affects the address discharge.

Therefore, there is a need to design a panel having optimally set widths of the X electrode 13 and the Y electrode 14 and height of the discharge cell 10. Japanese Laid-open Patent Publication No. 1997-330663 discloses a PDP design.

Another important element in PDP design is a partial pressure of Xe that may be included in the discharge gas.

Specifically, the discharge gas injected in the discharge cell may be formed by mixing He, Ne, and Xe, and increasing the partial pressure of Xe may improve discharge efficiency, reduce power consumption, and increase brightness.

On the other hand, an increased partial pressure of Xe may require a higher discharge voltage, which results in more active ion movements in the discharge cell and increased impacts caused by the ions contacting the phosphor layer. Further, increasing the partial pressure of Xe may reduce the address voltage margin. Thus, an optimal design of the panel is required when increasing the partial pressure of Xe.

SUMMARY OF THE INVENTION

The present invention provides a PDP that may ensure discharge stability, even with increased partial pressure of Xe, in order to improve discharge efficiency.

Additional features of the invention will be set forth in the description which follows, and in part will be apparent from the description, or may be learned by practice of the invention.

The present invention discloses a PDP including a sustain electrode pair comprising an X electrode and a Y electrode that are separated from each other by a discharge gap, and a barrier rib formed on a second substrate facing the first substrate and including first barrier ribs and second barrier ribs that define a discharge cell. Assuming that L is a sum of a width of the discharge gap and widths of the X and Y electrodes, P is a pitch between neighboring second barrier ribs, and H is a height of the first barrier ribs, a value of H satisfies $200\times L/P-25 \leqq H\ (\mu m) \leqq 200\times L/P-5$.

The present invention also discloses a method for fabricating a plasma display panel, comprising forming a sustain electrode pair on a surface of a first substrate and comprising an X electrode and a Y electrode separated from each other by a discharge gap, and forming first barrier ribs and second barrier ribs, on a surface of a second substrate facing the first substrate, that define a discharge cell. A height of the first barrier ribs is a function of a pitch between neighboring second barrier ribs and a width of the sustain electrode pair.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Figure 1:
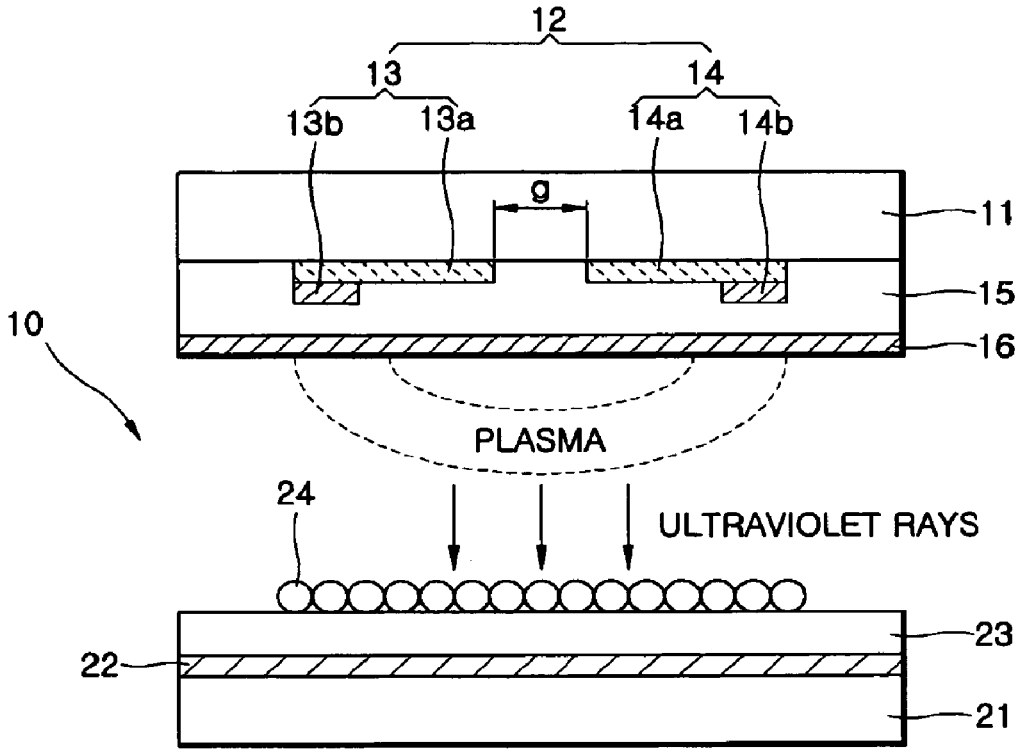
FIG. 1 (PRIOR ART)
FIG. 1 is a cross-sectional view showing a unit discharge cell of a conventional PDP.
Figure 2:
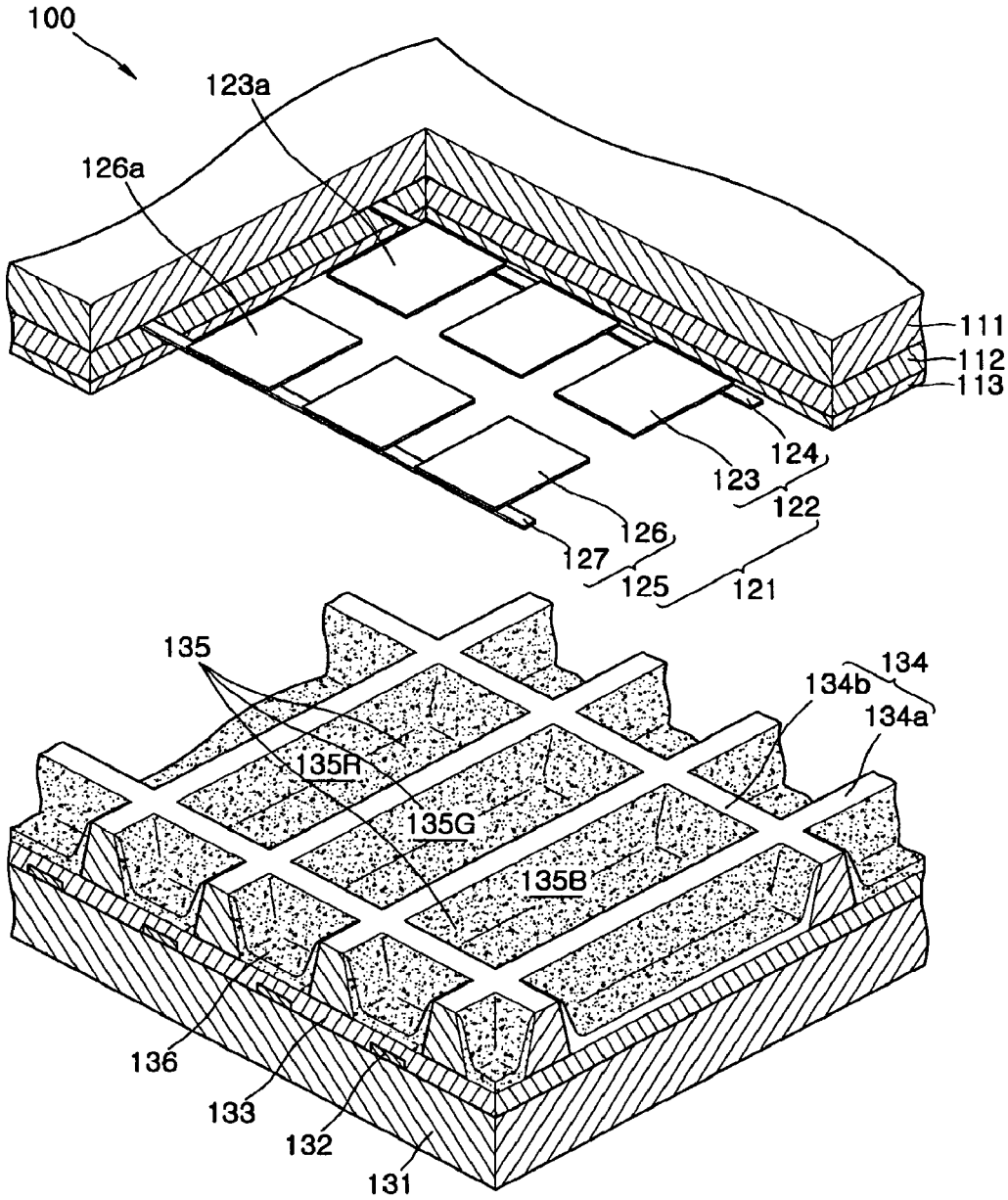
FIG. 2 is an exploded perspective view showing a PDP according to an exemplary embodiment of the present invention.
Figure 3:
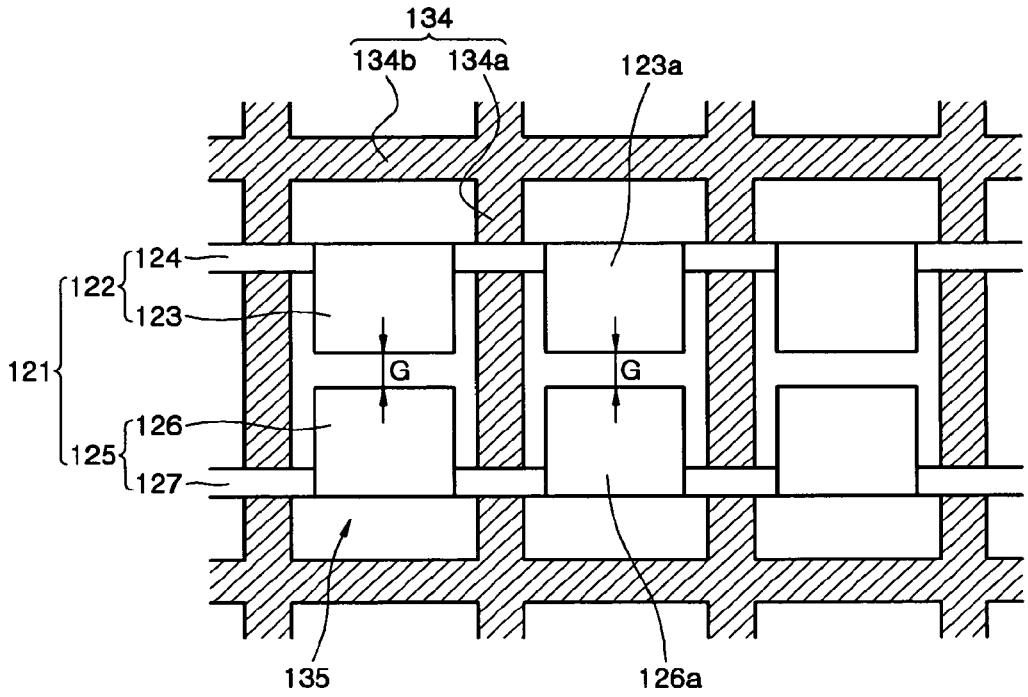
FIG. 3 is a plane view showing sustain electrodes arranged in a discharge cell of the PDP shown in FIG. 2.
Figure 4:
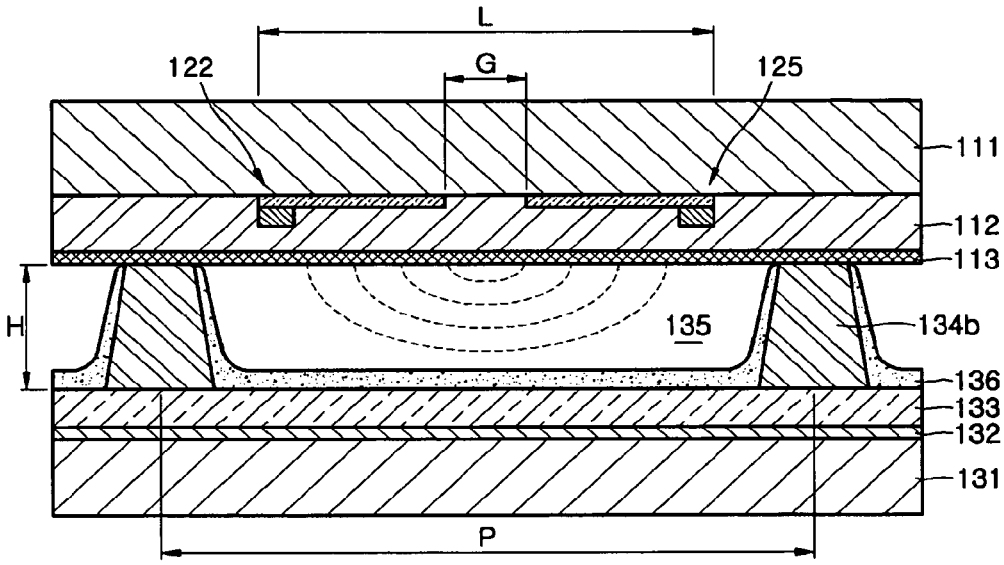
FIG. 4 is a cross-sectional view showing the PDP of FIG. 2.

FIG. 2 is an exploded perspective view showing a PDP according to an exemplary embodiment of the present invention, FIG. 3 is a plane view showing sustain electrodes arranged in discharge cells of the PDP of FIG. 2, and FIG. 4 is a cross-sectional view showing the PDP of FIG. 2.

Referring to FIG. 2, the PDP 100 includes a first substrate 111 and a second substrate 131 facing each other. A plurality of pairs of sustain electrodes 121 are arranged on a lower surface of the first substrate 111. Each sustain electrode pair includes an X electrode 122 and a Y electrode 125, where the X electrode 122 may function as a common electrode and the Y electrode 125 may function as a scan electrode.

The X electrode 122 and the Y electrode 125 respectively include transparent electrodes 123 and 126, which may be formed of a transparent conductive material such as indium tin oxide (ITO), and bus electrodes 124 and 127, which may be formed on surfaces of the transparent electrodes 123 and 126.

The transparent electrodes 123 and 126 may comprise a plurality of protrusions 123*a* and 126*a* having ends coupled to bus electrodes 124 and 127 with predetermined intervals therebetween. Other ends of the protrusions 123*a* and 126*a* may face each other with a predetermined discharge gap G therebetween.

The bus electrodes 124 and 127 may be formed of a metal such as Ag or Au in order to compensate for the line resistances of the transparent electrodes 123 and 126. The transparent electrodes are not limited to the above described exemplary embodiment as they may have various structures.

Additionally, the first substrate 111 may include a first dielectric layer 112 covering the pairs of the sustain electrodes 121, and a protective layer 113, which may be formed of MgO, may cover the first dielectric layer 112.

Address electrodes 132 are arranged on an upper surface of the second substrate 131 in a direction substantially orthogonal to the sustain electrodes 121.

A second dielectric layer 133 covers the address electrodes 132, and a barrier rib 134 may be formed on the second dielectric layer 133. The barrier rib 134 defines a plurality of discharge cells 135 and prevents generation of cross-talk between neighboring discharge cells 135.

The barrier rib 134 may comprise first barrier ribs 134*a* and second barrier ribs 134*b*, which extend from side surfaces of the first barrier ribs 134*a* to cross the first barrier ribs 134*a*. The first barrier ribs 134*a* may be arranged in parallel with, and in between, the address electrodes 132.

Forming the first and second barrier ribs 134*a* and 134*b* defines a plurality of discharge cells 135 having a matrix pattern with four closed sides. Forming the discharge cell 135 in the matrix form may provide a fine pitch and improved brightness and discharge efficiency. The shape of the barrier rib is not limited to the above matrix form. It may be formed in any shape that defines the discharge cells in a pattern of arranging pixels.

Applying a fluorescent material on an inner side surface of the barrier rib 134 and on an upper surface of the second dielectric layer 133 forms a phosphor layer 136. The phosphor layer 136 may include red, green, and blue colors.

Additionally, according to the phosphor layer colors, the discharge cell 135 may include red, green, and blue discharge cells 135R, 135G, and 135B, and a unit pixel may comprise three neighboring discharge cells 135R, 135G, and 135B. In the quadrilateral-shaped unit pixel, a pitch between neighboring first barrier ribs 134*a* may be ⅓ of the pitch between neighboring second barrier ribs 134*b*. However, it is not limited thereto.

A discharge gas comprising He, Ne, and Xe may be filled in the discharge cell 135, and a partial pressure of the Xe may be 10% or greater.

Applying a sealant, such as a frit glass, on edges of the first and second substrates 111 and 131 may seal them together.

As FIG. 3 shows, an X electrode 122 and a Y electrode 125 may be disposed from edges of the discharge cell 135 toward the cell's inner portion. A discharge gap G separates the X and Y electrodes 122 and 125 from each other.

More specifically, the protrusions 123*a* and 126*a* of transparent electrodes 123 and 126 may be separately disposed on the discharge cell 135 to correspond to each other, and the first barrier rib 134*a* may be formed between them. Further, both sides of the protrusions 123*a* and 126*a* may be separated from the neighboring first barrier ribs 134*a*. As described above, removing portions of the transparent electrodes 123 and 126 that correspond to the first barrier rib 134*a* may reduce circuit current, thereby improving the panel's light emitting efficiency. The first and second barrier ribs 134*a* and 134*b* may have the same height. Alternatively, the second barrier rib 134*b* may be lower than the first barrier rib 134*a*.

The bus electrodes 124 and 127, which are coupled to the transparent electrodes 123 and 126, may be arranged in parallel to the second barrier rib 134*b*. The bus electrodes 124 and 127 may also be separated from the edges of, but disposed in, the discharge cell 135. An address electrode 132 may be disposed under the discharge cell 135 in a direction crossing the X and Y electrodes 122 and 125.

As FIG. 4 shows, a discharge between the X electrode 122 and the Y electrode 125 starts at the discharge gap G and diffuses far from the discharge gap G along the surfaces of the X and Y electrodes 122 and 125. Additionally, the dotted lines of FIG. 4 denote a discharge path that may form in the discharge cell 135.

Varying the widths of the X and Y electrodes 122 and 125 may vary the discharge path width, which determines a height of the discharge path. Further, the height of the space in the discharge cell 135 should ensure that the discharge path does not contact the phosphor layer 136 without negatively affecting the address discharge. Here, the height of the barrier rib 134 may determine the height of the space in the discharge cell 135.

According to an exemplary embodiment of the present invention, in order to improve discharge efficiency, the partial pressure of the Xe included in the discharge gas may be 10% or greater. Thus, the PDP 100 should be designed to optimize discharge efficiency and ensure discharge stability in light of this increased partial pressure.

Therefore, assuming that L is a sum of the width of the discharge gap G and the widths of the X and Y electrodes 122 and 125, P is a pitch between neighboring second barrier ribs 134*b*, and H is the height of the first barrier rib 134*a*, a relation between H and L/P may be set. FIG. 4 shows a case where the height H of the first barrier rib 134*a* equals the height of the second barrier rib 134*b*.

Moreover, the relation between the values of L/P and H may be set based on data calculated through the experiments shown in Tables 1 through 6 below.

Table 1 shows measured discharge efficiency data for various values of H and L/P, and Table 2 shows experimental results of discharge stability according to H and L/P. Here, the pressure of the discharge gas is 500 Torr, and the partial pressure of Xe is 10%. The "-" in Tables 1, 3 and 5 refers to a negligible discharge efficiency, and a unit of the discharge efficiency is 1 m/W. In Tables 2, 4 and 6, "0" refers to a stable discharge, and "X" refers to a discharge failure.

TABLE 1

| | | L/P | | | |
|---|---|---|---|---|---|
| | | 0.55 | 0.60 | 0.65 | 0.70 |
| H(μm) | 90 | 1.96 | 1.85 | 1.76 | — |
| | 100 | 1.96 | 1.95 | 1.87 | 1.77 |
| | 110 | 2.01 | 1.98 | 1.95 | 1.9 |
| | 120 | 2.16 | 2.11 | 2.1 | 2.1 |
| | 130 | — | 2.15 | 2.15 | 2.13 |
| | 140 | — | — | — | 2.15 |

TABLE 2

| | | L/P | | | |
|---|---|---|---|---|---|
| | | 0.55 | 0.60 | 0.65 | 0.70 |
| H(μm) | 90 | ○ | ○ | ○ | ○ |
| | 100 | ○ | ○ | ○ | ○ |
| | 110 | X | ○ | ○ | ○ |
| | 120 | X | X | ○ | ○ |
| | 130 | X | X | X | ○ |
| | 140 | X | X | X | ○ |

Referring to Table 1, increasing the value of L/P at a fixed value of H may decrease the discharge efficiency. Increasing L while maintaining the same H increases the width and height of the discharge path, thus the discharge path may contact the phosphor layer, which may negatively affect the discharge. On the other hand, when the value of L/P is 0.5 or less, the discharge areas of the X and Y electrodes 122 and 125 may not be sufficient. Consequently, the value of L/P may be in a range of about 0.55 to about 0.7.

Additionally, increasing the value of H at a fixed value of L/P may gradually increase the discharge efficiency. However, increasing the value of H may cause an unstable address discharge, which is a discharge that occurs between an address electrode and a Y electrode, because increasing H increases the distance between the address and Y electrodes.

Referring to Table 2, when L/P is 0.55 and H is 110 μm, when L/P is 0.60 and H is 120 μm, when L/P is 0.65 and H is 130 μm, and when L/P is 0.70 and H is 140 μm, the address voltage margin may not be sufficiently ensured, and the address discharge operation may fail. Here, the address voltage margin is a difference between maximum and minimum values of the address voltage, by which the stable discharge status may be maintained.

Therefore, based on the data of Table 1 and Table 2, satisfying equation (1) may set an optimal condition for stable address discharge and maximized discharge efficiency.

$$H(\mu m)=200\times L/P-15 \quad (1)$$

Additionally, when the value of H is changed within a range of ±10 μm according to the data of Table 1, the discharge efficiency changes by 5% or less. Hence, equation (2) provides a range of the value of H according to the value of L/P.

$$200\times L/P-25 \leqq H(\mu m) \leqq 200\times L/P-5 \quad (2)$$

As equation (2) shows, the value of L/P may be set within the range of about 0.55 to about 0.7, and the value of H may be set within a range of 200×L/P−25 through 200×L/P−5, thus optimizing discharge efficiency and ensuring discharge stability.

Table 3 and Table 4 show experimental results of the discharge efficiency and discharge stability according to the values of H and L/P in a case where the partial pressure of Xe is 30%. The other experimental conditions are the same as those of the above experiments.

TABLE 3

| | | L/P | | | |
|---|---|---|---|---|---|
| | | 0.55 | 0.60 | 0.65 | 0.70 |
| H(μm) | 90 | 2.45 | 2.15 | 1.96 | — |
| | 100 | 2.49 | 2.45 | 2.37 | 2.35 |
| | 110 | 2.60 | 2.58 | 2.45 | 2.4 |
| | 120 | 2.62 | 2.61 | 2.50 | 2.44 |
| | 130 | — | 2.52 | 2.52 | 2.48 |
| | 140 | — | — | — | 2.49 |

TABLE 4

| | | L/P | | | |
|---|---|---|---|---|---|
| | | 0.55 | 0.60 | 0.65 | 0.70 |
| H(μm) | 90 | ○ | ○ | ○ | ○ |
| | 100 | ○ | ○ | ○ | ○ |
| | 110 | X | ○ | ○ | ○ |
| | 120 | X | X | ○ | ○ |
| | 130 | X | X | X | ○ |
| | 140 | X | X | X | X |

The discharge efficiency and discharge stability data shown in Tables 3 and 4 are similar to those of Tables 1 and 2. In other words, fixing H and increasing L/P may reduce discharge efficiency. Additionally, fixing L/P and increasing H may gradually increase discharge efficiency, however, the address discharge may become unstable as H increases.

From the experimental results of the discharge efficiency and the discharge stability with the partial pressure of Xe at 30%, a linear relation between the values of L/P and H, which may satisfy the conditions for stable address discharge and maximum discharge efficiency, may be set per equations (1) and (2).

Table 5 and Table 6 show experimental results of the discharge efficiency and discharge stability according to the values of H and L/P in a case where the partial pressure of Xe

TABLE 5

| | | L/P | | | |
|---|---|---|---|---|---|
| | | 0.55 | 0.60 | 0.65 | 0.70 |
| H(μm) | 90 | 2.79 | 2.6 | 2.56 | — |
| | 100 | 2.85 | 2.77 | 2.59 | 2.49 |
| | 110 | 2.89 | 2.85 | 2.79 | 2.53 |
| | 120 | 2.96 | 2.91 | 2.85 | 2.59 |
| | 130 | — | — | 2.89 | 2.76 |
| | 140 | — | — | — | 2.72 |

TABLE 6

| | | L/P | | | |
|---|---|---|---|---|---|
| | | 0.55 | 0.60 | 0.65 | 0.70 |
| H(μm) | 90 | ○ | ○ | ○ | ○ |
| | 100 | ○ | ○ | ○ | ○ |
| | 110 | X | ○ | ○ | ○ |
| | 120 | X | X | ○ | ○ |
| | 130 | X | X | X | X |
| | 140 | X | X | X | X |

The discharge efficiency and discharge stability data shown in Tables 5 and 6 are similar to those of Tables 1 through 4. Therefore, with the partial pressure of Xe at 50%, a linear relation between the values of L/P and H, which may satisfy the conditions of performing stable address discharge and maximizing discharge efficiency, may be set per equations (1) and (2). Consequently, the linear relation between the values of L/P and H may be set per equations (1) and (2) when the partial pressure of the Xe within a range of about 10% to about 50%.

As described above, according to the PDP of exemplary embodiments of the present invention, discharge efficiency may be maximized while ensuring discharge stability. Additionally, even when Xe has a higher partial pressure than that of the conventional art, stable discharging may be performed.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel (PDP), comprising:

a first substrate including a sustain electrode pair comprising an X electrode and a Y electrode that are separated from each other by a discharge gap; and a barrier rib formed on a second substrate facing the first substrate and including first barrier ribs and second barrier ribs that define a discharge cell;

wherein $200\times L/P-25 \leqq H(\mu m) \leqq 200\times L/P-5$;

wherein L is a sum of a width of the discharge gap and widths of the X electrode and the Y electrode;

wherein P is a pitch from a second barrier rib of the discharge cell to a corresponding second barrier rib of an adjacent discharge cell; and wherein H is a height of the first barrier ribs.

2. The PDP of claim 1, further comprising:

a discharge gas comprising Xe in the discharge cell, wherein a partial pressure of Xe is within a range of about 10% to about 50%.

3. The PDP of claim 1, wherein $H(\mu m)=200\times L/P-15$.

4. The PDP of claim 1, wherein the X electrode and the Y electrode comprise a transparent electrode protruding in the discharge cell and a bus electrode coupled to the transparent electrode.

5. The PDP of claim 4, wherein the transparent electrodes comprise a plurality of protrusions, and an X electrode protrusion and a Y electrode protrusion are disposed in the discharge cell.

6. The PDP of claim 5, wherein both sides of the X electrode protrusion and the Y electrode protrusion are separated from the first barrier ribs.

7. The PDP of claim 1, wherein a pitch between neighboring first barrier ribs is about P/3.

8. The PDP of claim 1, further comprising:

a first dielectric layer covering the sustain electrode pair;

a protective layer covering the first dielectric layer;

an address electrode formed on an upper surface of the second substrate and in a direction crossing the sustain electrode pair; and a second dielectric layer covering the address electrode, wherein the barrier rib is formed on the second dielectric layer.

9. The PDP of claim 8, wherein the address electrode is parallel to, and in between, the first barrier ribs.

10. A plasma display panel (PDP), comprising:

a first substrate including a sustain electrode pair comprising an X electrode and a Y electrode that are separated from each other by a discharge gap; and a barrier rib formed on a second substrate facing the first substrate and including first barrier ribs and second barrier ribs that define a discharge cell;

wherein L/P is in a range of 0.55 to 0.7 and H (μm) is in a range of 120 to 140 μm;

wherein L is a sum of a width of the discharge gap and widths of the X electrode and the Y electrode;

wherein P is a pitch between neighboring second barrier ribs; and wherein H is a height of the first barrier ribs.

11. The PDP of claim 10, further comprising:

a discharge gas comprising Xe in the discharge cell, wherein a partial pressure of Xe is within a range of about 10% to about 50%.

12. The PDP of claim 10, wherein the X electrode and the Y electrode comprise a transparent electrode protruding in the discharge cell and a bus electrode coupled to the transparent electrode.

13. The PDP of claim 12, wherein the transparent electrodes comprise a plurality of protrusions, and an X electrode protrusion and a Y electrode protrusion are disposed in the discharge cell.

14. The PDP of claim 13, wherein both sides of the X electrode protrusion and the Y electrode protrusion are separated from the first barrier ribs.

15. The PDP of claim 10, wherein a pitch between neighboring first barrier ribs is about P/3.

16. The PDP of claim 10, further comprising:

a first dielectric layer covering the sustain electrode pair;

a protective layer covering the first dielectric layer;

an address electrode formed on an upper surface of the second substrate and in a direction crossing the sustain electrode pair; and a second dielectric layer covering the address electrode, wherein the barrier rib is formed on the second dielectric layer.

17. The PDP of claim 16, wherein the address electrode is parallel to, and in between, the first barrier ribs.

* * * * *